US007572139B2

(12) United States Patent
Montena

(10) Patent No.: US 7,572,139 B2
(45) Date of Patent: Aug. 11, 2009

(54) SELF-RETAINING AUDIO/VIDEO HIGH DEFINITION MULTI-CONTACT CONNECTOR AND CONNECTION METHOD

(75) Inventor: Noah Montena, Syracuse, NY (US)

(73) Assignee: John Mezzalingua Associates, Inc., E. Syracuse, NY (US)

( * ) Notice: Subject to any disclaimer, the term of this patent is extended or adjusted under 35 U.S.C. 154(b) by 0 days.

(21) Appl. No.: 11/860,138

(22) Filed: Sep. 24, 2007

(65) Prior Publication Data

US 2009/0081899 A1 Mar. 26, 2009

(51) Int. Cl.
*H01R 13/627* (2006.01)

(52) U.S. Cl. ..... 439/358

(58) Field of Classification Search ..... 439/357, 439/353, 358, 354, 385, 131
See application file for complete search history.

(56) References Cited

U.S. PATENT DOCUMENTS 6,250,945 B1 * 6/2001 Murakami et al. ..... 439/353
6,257,914 B1 7/2001 Comerci et al.
6,364,687 B1 4/2002 Chen
6,431,887 B1 8/2002 Yeomans et al.
6,579,108 B1 * 6/2003 Goff ..... 439/131
6,595,801 B1 7/2003 Leonard et al.
6,860,750 B1 3/2005 Wu
6,884,104 B2 * 4/2005 Homer ..... 439/344
6,902,432 B2 6/2005 Morikawa et al.
6,935,896 B1 8/2005 Tsai
6,948,965 B2 9/2005 Kumamoto et al.
6,997,733 B2 * 2/2006 Peng ..... 439/353
7,097,472 B2 * 8/2006 Parker ..... 439/131
7,381,076 B2 * 6/2008 Bychkov et al. ..... 439/344
2006/0141843 A1 * 6/2006 Huang et al. ..... 439/350
2006/0141865 A1 * 6/2006 Su et al. ..... 439/607
2006/0148300 A1 7/2006 Huang et al.

* cited by examiner

*Primary Examiner*—Michael C Zarroli
(74) *Attorney, Agent, or Firm*—Schmeiser, Olsen & Watts

(57) ABSTRACT

A self-retaining HDMI compatible connector comprises an inner plug section and at least one retaining portion resiliently expanded a distance away from the inner plug section and operably movable to be compressed for insertion and/or retraction during mating of the connector with a standard HDMI jack. The expanded retaining portion exerts a force against the jack receptacle and helps to impede removal of the connector once mated with the jack.

23 Claims, 17 Drawing Sheets

| Pin | Signal |
|---|---|
| 1 | TMDS Data2+ |
| 2 | TMDS Data2 Shield |
| 3 | TMDS Data2- |
| 4 | TMDS Data1+ |
| 5 | TMDS Data1 Shield |
| 6 | TMDS Data1- |
| 7 | TMDS Data0+ |
| 8 | TMDS Data0 Shield |
| 9 | TMDS Data0- |
| 10 | TMDS Clock+ |
| 11 | TMDS Clock Shield |
| 12 | TMDS Clock- |
| 13 | CEC |
| 14 | Reserved (N.C. on Device) |
| 15 | SCL |
| 16 | SDA |
| 17 | DDC/CEC Ground |
| 18 | +5V |
| 19 | Hot Plug Detect |

FIG. 15

| Pin | Signal |
|---|---|
| 1 | TMDS Data2+ |
| 2 | TMDS Data2 Shield |
| 3 | TMDS Data2- |
| 4 | TMDS Data1+ |
| 5 | TMDS Data1 Shield |
| 6 | TMDS Data1- |
| 7 | TMDS Data0+ |
| 8 | TMDS Data0 Shield |
| 9 | TMDS Data0- |
| 10 | TMDS Clock+ |
| 11 | TMDS Clock Shield |
| 12 | TMDS Clock- |
| 13 | TMDS Data5+ |
| 14 | TMDS Data5 Shield |
| 15 | TMDS Data5- |
| 16 | TMDS Data4+ |
| 17 | TMDS Data4 Shield |
| 18 | TMDS Data4- |
| 19 | TMDS Data3+ |
| 20 | TMDS Data3 Shield |
| 21 | TMDS Data3- |
| 22 | CEC |
| 23 | Reserved (N.C. on Device) |
| 24 | Reserved (N.C. on Device) |
| 25 | SCL |
| 26 | SDA |
| 27 | DDC/CEC Ground |
| 28 | +5V |
| 29 | Hot Plug Detect |

FIG. 16

SELF-RETAINING AUDIO/VIDEO HIGH DEFINITION MULTI-CONTACT CONNECTOR AND CONNECTION METHOD

BACKGROUND OF THE INVENTION

1. Technical Field

The present invention relates generally to high definition cable communications. More particularly, the present invention relates to an apparatus and a method for improving the mechanical connection between a compatible high definition multimedia interface (HDMI) connector and a standard HDMI™ jack. (HDMI, the HDMI logo and High-Definition Multimedia Interface are trademarks or registered trademarks of HDMI Licensing, LLC).

2. Related Art

The onset of High Definition Televisions has fostered increased production of peripheral high definition (HD) components, such as cable boxes, DVD players, and mass storage devices that are operable to communicate and/or store HD multimedia content. To facilitate transmittal of HD multimedia content between various HD components, high definition multimedia interface (HDMI) cables, connectors, jacks, adaptors, and other connection accessories have been provided. As shown in FIGS. 1-4, a standard HDMI connector 1000 is commonly held onto a typical HDMI jack 20 via friction interference fittings. For example, spring biased tabs 22 positioned in openings 25 of a typical HDMI jack 20 are configured to fit into corresponding detents 1030 on an extension 1020 of a typical HDMI connector 1000 to provide some interference between mated components and further assist in the retention of the standard HDMI connector 1000 as mated within the typical HDMI jack 20. However, the common configuration of standard HDMI connectors 1000 is susceptible to poor performance due to structural and operable deficiencies; the standard connectors 1000 tend to come loose. Although the common spring biased tabs 22 provide some resistance to unwanted retraction of standard HDMI connectors 1000, ordinary bumping of the connectors 1000 or associated cables while cleaning, dusting, or moving electrical devices often loosens the standard HDMI connectors 1000 from proper mating positions with typical HDMI jacks 20. Moreover, the increasing use of wall mounted flat screen televisions, out of necessity or for the sake of aesthetics, has led to the increasing placement of HDMI jack receptacles 20 that face downward. The downward orientation of the HDMI jack receptacles 20 can further contribute to loose connections and signal loss if there is not sufficient friction between the connectors 1000 and the jacks 20 to maintain contact as the associated standard HDMI cable connectors 1000 fall out of the receptacle opening 27 of jack 20 and become unplugged or otherwise become disconnected due to the pull of gravity. Accordingly, a need exists for providing a self-retaining HDMI compatible connector and related HDMI compatible connection method.

SUMMARY OF THE INVENTION

The present invention provides an apparatus and method for use with HDMI compatible cable connections that offers improved reliability.

A first aspect of the invention provides a self-retaining audio/video high definition multi-contact connector comprising: a first end, configured to be inserted into a standard HDMI jack; and an inner plug section, forming a portion of the first end, the inner plug section being partially surrounded by a first retaining portion movable from a first normal expanded position, wherein the first retaining portion extends a distance away from the inner plug section at the first end to a second unexpanded position, wherein the first retaining portion is in close proximity to the inner plug section at the first end, and wherein the first retaining portion is configured to exert a restoring force back toward the first position when the first retaining portion is within the standard HDMI jack.

A second aspect of the invention provides a high definition multimedia interface compatible connector comprising: a plug end, the plug end having an outer movable first retaining portion, the movable first retaining portion being movable between a first open position to a second closed position; wherein the first retaining portion in the first open position has a dimension larger than a receptacle opening of a standard HDMI jack; and, wherein the first retaining portion in the second closed position has a dimension smaller than the receptacle opening of the standard HDMI jack.

A third aspect of the invention provides a self-retaining HDMI compatible connector comprising: a plug end configured to be inserted into a standard HDMI jack; and movable retention means located on the plug end for firmly but releasably retaining the connector in a mated position with the standard HDMI jack.

A fourth aspect of the present invention provides a method of connecting a connector to a corresponding standard HDMI jack, the method comprising: providing an audio/video high definition multi-contact connector including: an inner plug section having a first end configured to be inserted into a receptacle opening of a standard HDMI jack; and a compressible first retaining portion that extends away from the inner plug section at the first end in a first normal expanded position; applying a force to compress the first retaining portion to a second unexpanded position having a dimension smaller than the receptacle opening of the standard HDMI jack; inserting the first end of the connector into the standard HDMI jack; and releasing the compression force on the first retaining portion so that the first retaining portion resiliently returns toward its first normal expanded position and exerts a force upon the standard HDMI jack to impede removal of the connector from the jack.

BRIEF DESCRIPTION OF THE DRAWINGS

Some of the embodiments of this invention will be described in detail, with reference to the following FIGURES, wherein like designations denote like members, wherein:

FIG. 15 depicts a 19 pin layout of a HDMI compatible connector; and

FIG. 16 depicts a 29 pin layout of a HDMI compatible connector.

DETAILED DESCRIPTION OF THE INVENTION

Figure 1:
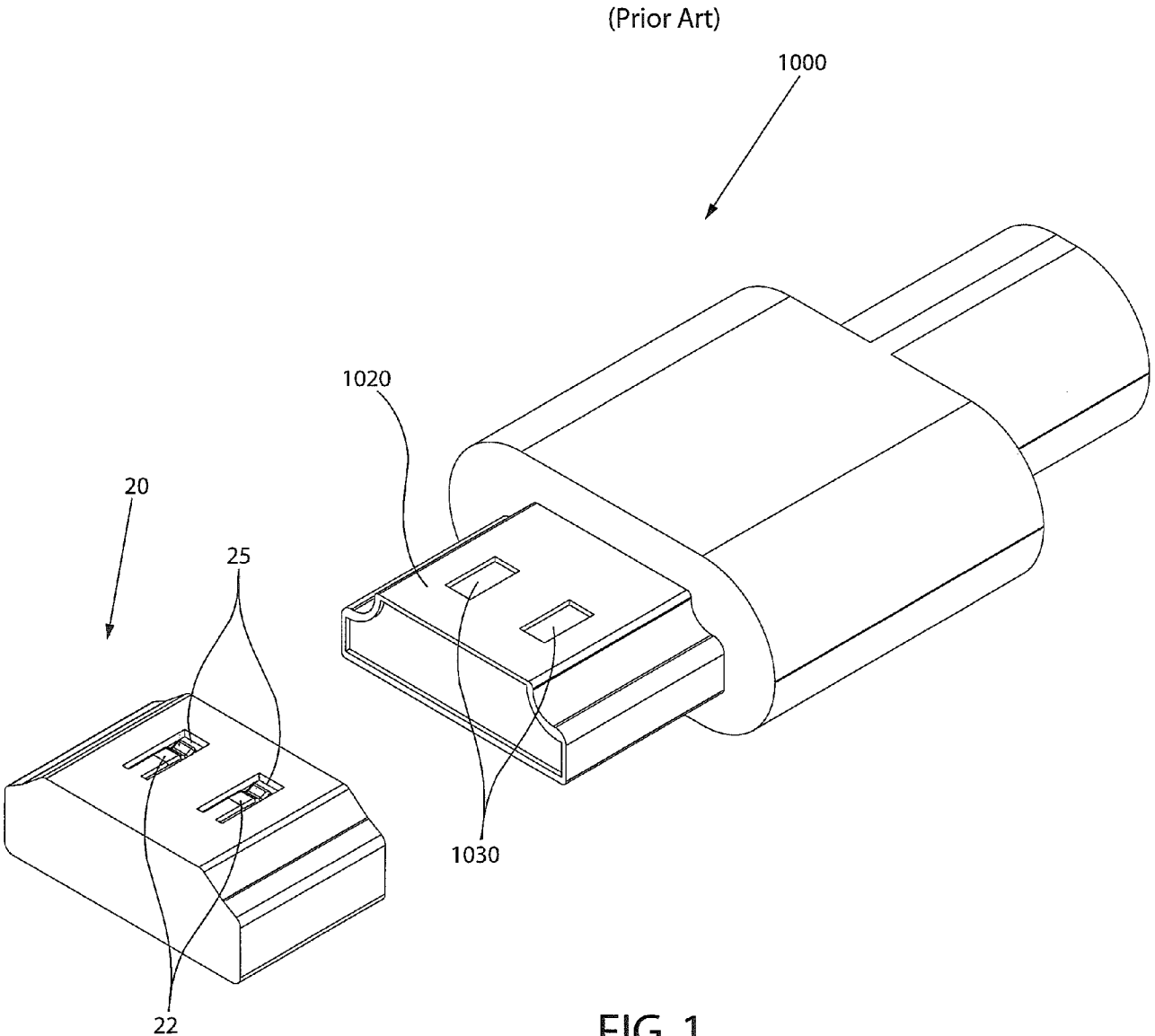
FIG. 1 depicts a perspective view of a standard HDMI plug of the prior art prior to mating with a typical HDMI jack; flawed.
Figure 2:
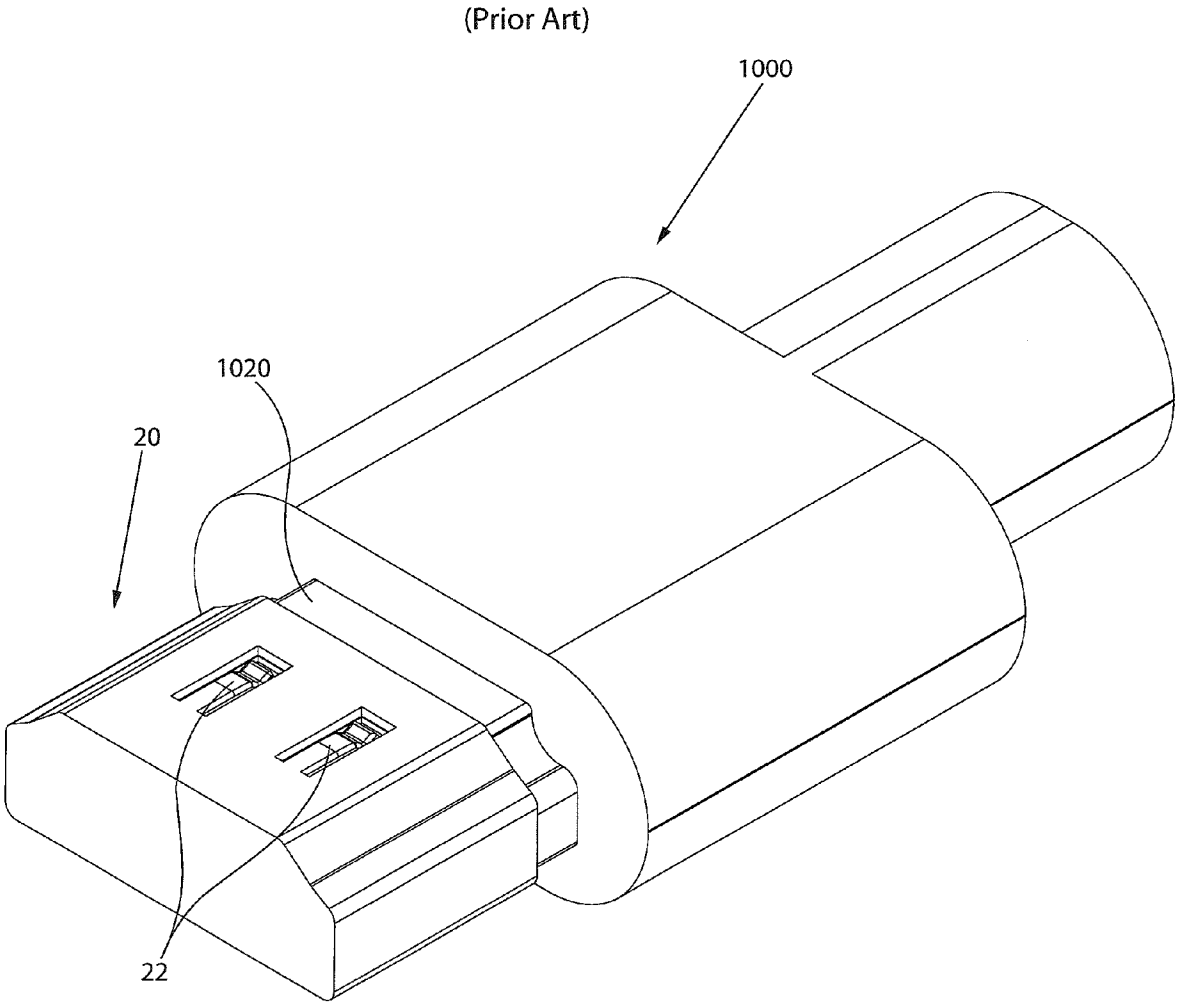
(Prior Art) FIG. 2
FIG. 2 depicts a perspective view of a standard HDMI plug of the prior art as mated with a typical HDMI jack.
Figure 3:
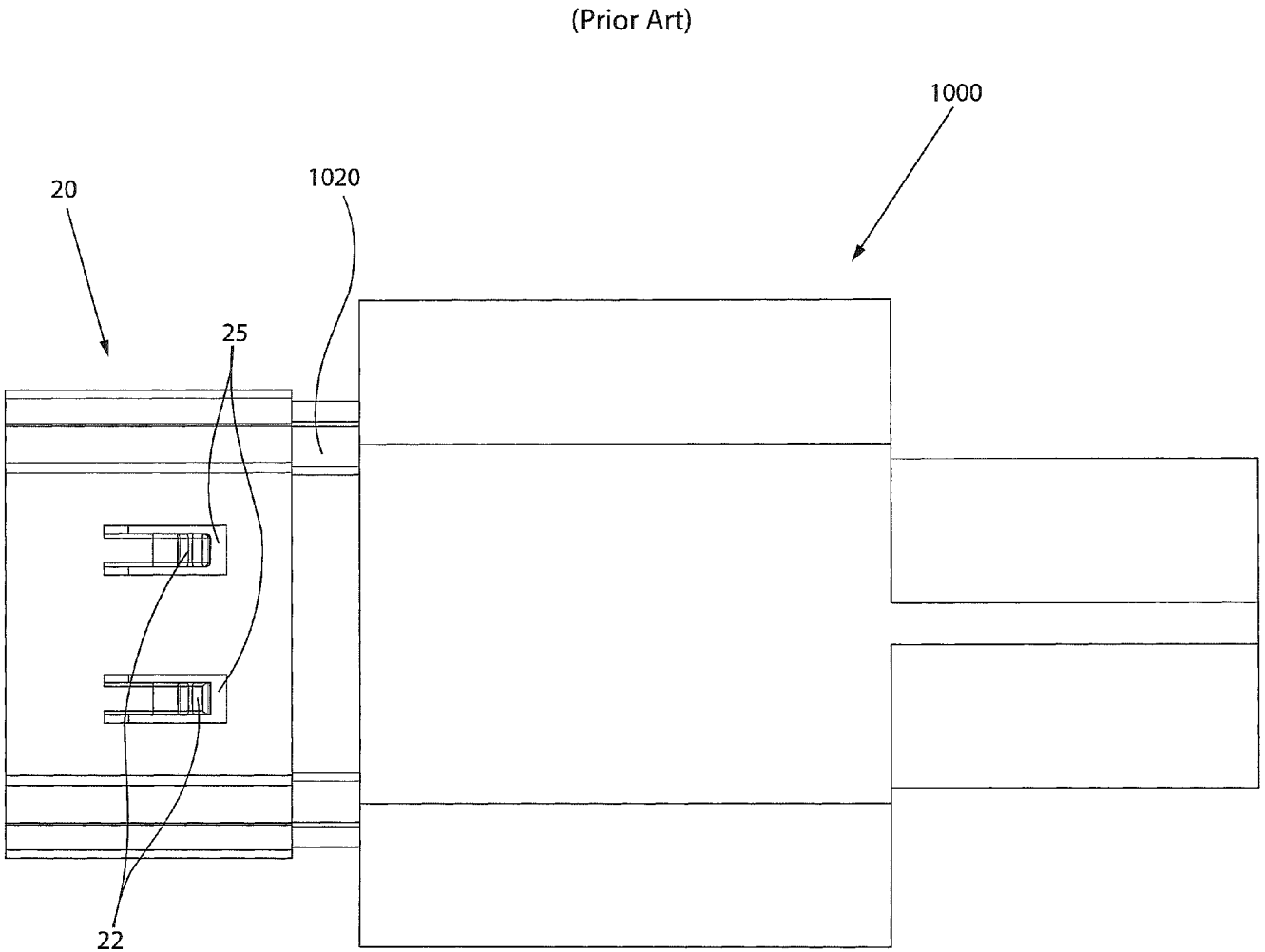
(Prior Art) FIG. 3
FIG. 3 depicts a top view of a standard HDMI plug of the prior art as mated with a typical HDMI jack.
Figure 4:
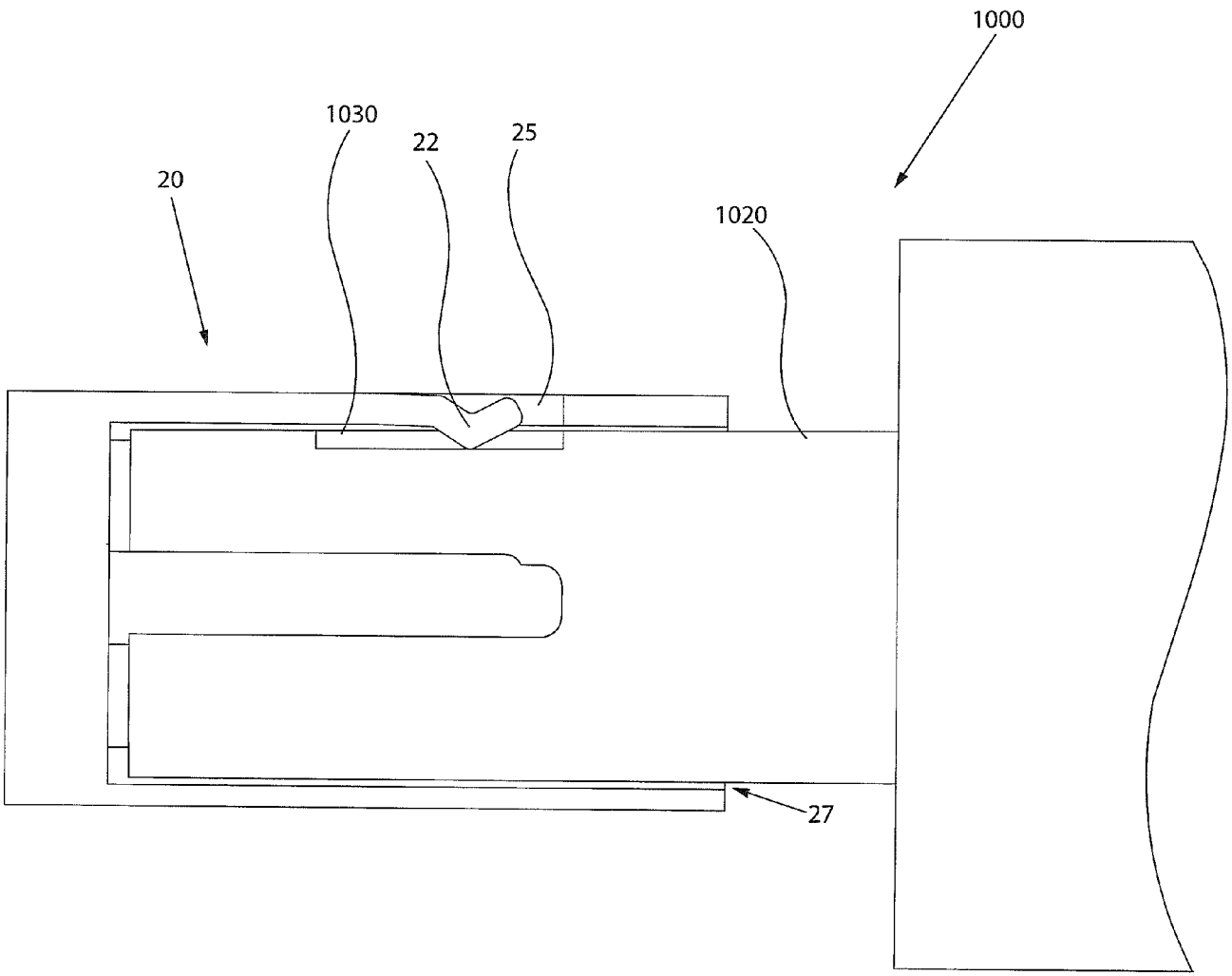
(Prior Art) FIG. 4
FIG. 4 depicts a partial cutaway side view of a standard HDMI plug of the prior art as mated with a typical HDMI jack.

Although certain embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply for exemplary purposes in depicting a possible embodiment or embodiments of the present invention. The features and advantages of the present invention are illustrated in detail in the accompanying drawings, wherein like reference numerals refer to like elements throughout the drawings.

As a preface to the detailed description, it should be noted that, as used in this specification and the appended claims, the singular forms "a", "an" and "the" include plural referents, unless the context clearly dictates otherwise.

Figure 5:
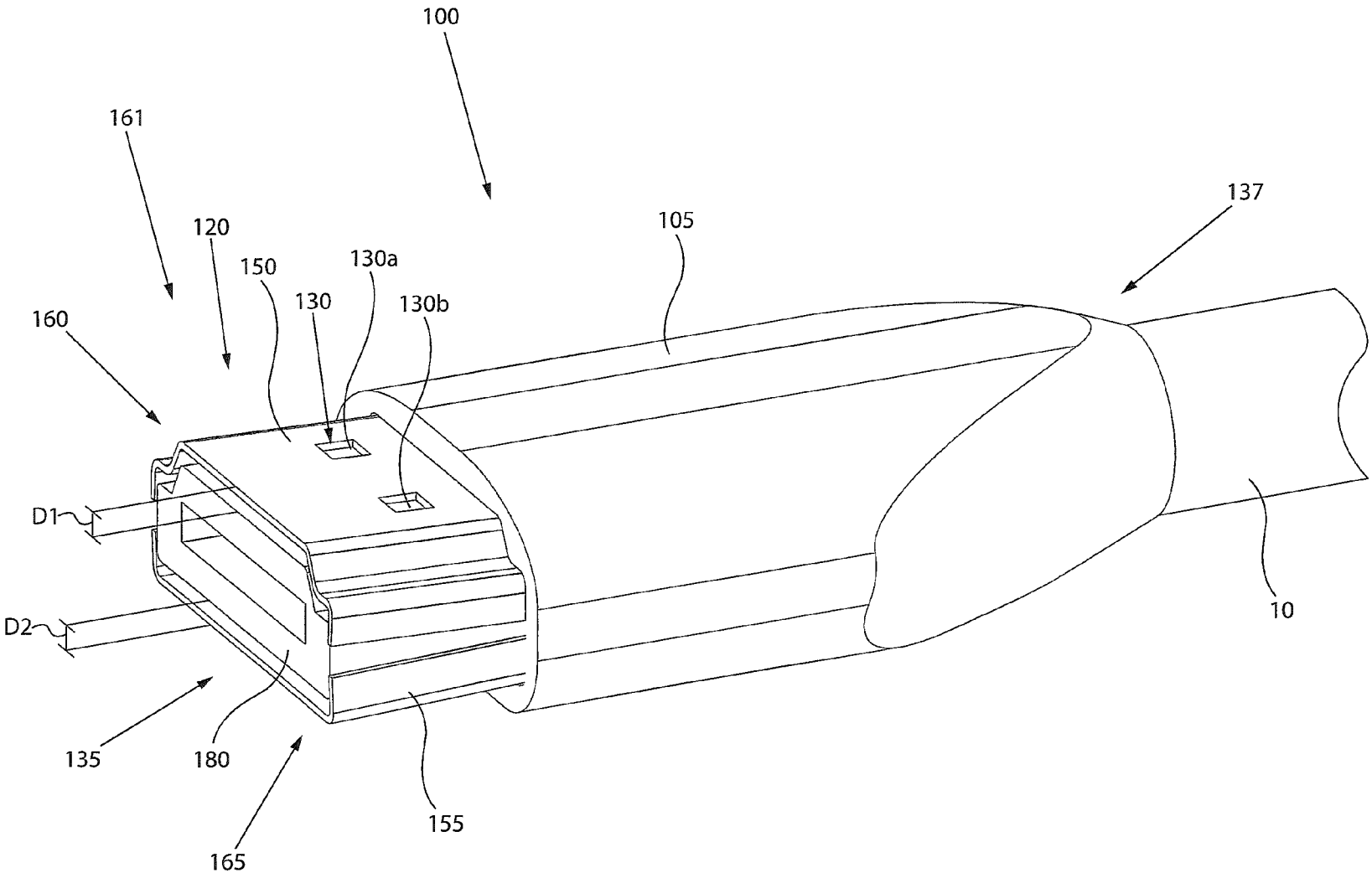
FIG. 5 depicts a perspective view of an embodiment of a self-retaining connector in an open first normal expanded position, in accordance with the present invention.

With reference to the drawings, FIG. 5 depicts a perspective view of an embodiment of a self-retaining connector 100 for connecting multi-conductor cable 10, HD adaptors, or other high definition devices to HD electronic components having standard HDMI jacks. The self-retaining connector may be an audio/video high definition multi-contact connector 100. Accordingly, the self-retaining connector 100 has a first end 135. The first end may be a plug end 135 configured to be plugged into a standard HDMI jack 20 (see FIGS. 1-4). The first plug end 135 of the self-retaining connector 100 includes at least a portion of an inner plug section 180 of the self-retaining connector 100. In addition, the self-retaining connector 100 comprises a connector body or plug body 105. The connector 100 may include an extension 120 extending from the plug body 105. The extension 120 may include the inner plug section 180 of the first plug end 135 of the self-retaining connector 100. The first plug end 135 of the connector 100 further includes a first retaining portion 150. The first retaining portion 150 is configured to partially surround or cover at least a part of the inner plug section 180 at the first plug end 135. Additionally, the first retaining portion 150 may include at least one jack mating structure 130, such as a hole or detent, wherein the jack mating structure 130 is sized and positioned relative to the first end 135 of self-retaining connector 100 so that the mating structure 130 may be aligned to physically mate with a friction interference fitting, such as spring biased tab 22 positioned in an opening 25, of a typical HDMI jack 20. (See FIGS. 1-4). The first retaining portion 150 of the self-retaining connector 100 may include two mating structures 130*a* and 130*b* so that the mating structures 130*a-b* may have some likeness to typical detents 1030 on an extension 1020 of a standard HDMI connector plug 1000. The first retaining portion 150 is configured to cover at least a part of the inner section 180 of the first plug end 135 of the connector 100. In addition, the first retaining portion 150 may be located to comprise at least a portion the extension 120 from the plug body 105. The first retaining portion 150 may facilitate electrical grounding. The first plug end 135 of the connector 100 may also optionally include a second retaining portion 155. The second retaining portion 155 may likewise be located to cover at least a portion the inner plug section 180 of the first plug end 135 of the self-retaining connector 100. Furthermore, the self-retaining connector 100 may have a cable connection end 137 and the plug body 105 may be configured to help retain a connected multi-conductor cable 10.

As depicted in FIG. 5, the self-retaining connector 100 is shown in an open position 161, wherein the first retaining portion 150 of the connector 100 is in a first normal expanded position 160. When the first retaining portion 150 is in a first normal expanded position 160 the first retaining portion 150 extends up to a distance D1 away from the inner plug section 180. Moreover, as also depicted in FIG. 5, when the connector 100 is in an open position 161, the second retaining portion 155 is in a first normal expanded position 165. When the second retaining portion 155 is in a first normal expanded position 165 the second retaining portion 155 extends up to a distance D2 away from the inner plug section 180. The physical dimensions and positioning of the first and second retaining portions 150, 155, when the connector 100 is in an open position 161, may be provided such that the distance D1 of the first retaining portion 150 in a first normal expanded position 160 is the same as the distance D2 of the second retaining portion 155 in a first normal expanded position 165. However, those skilled in the art should recognize that the distances D1 and D2 may be different when the connector 100 is in an open position 161. Furthermore, those in the art should appreciate that embodiments of a self-retaining connector 100 may not include a second retaining portion 155 or corresponding expanded distance D2. Where an embodiment of a self-retaining connector 100 does not include a second retaining portion 155, the inner plug section 180 may be sized to maintain the dimensions of the HDMI compatible first plug end 135 of the connector 100 to operably associate with the dimensions of a standard HDMI jack, such as jack 20. (See FIGS. 1-4). When the self-retaining connector 100 is in a normal free state open position 161 pertaining to the first expanded positions 160, 165 of the first and second retaining portions 150, 155, the dimension of the first plug end 135 of the connector 100 is larger than the dimension of a receptacle opening 27 of a standard HDMI jack 20. The expanded positions 160, 165 of the first and the second retaining portions 150, 155 are the normal physical orientations and locations of the retaining portions 150, 155 when the retaining portions 150, 155 are statically at rest with no applied forces acting thereon. Hence, the retaining portions 150, 155 are spaced away from the inner plug section 180 when the plug 100 is in a free state open position 161. The retaining portions 150, 155 should be resistively movable. As such, the retaining portions 150, 155 may be formed of resilient, compliant, springy or elastic material that may have inherent tendency to remain in a first normal expanded position and configuration and will exert a restoring force when moved out of the first normal expanded position 160, 165. The retaining portions 150, 155 may also be formed of sturdy, rigid material and may be in operable contact with an internal spring or other force resistive element within plug body 105. Accordingly, when forces are applied to the first and/or second retaining portions 150, 155, the retaining portions 150, 155 may exert opposing force resistive of movement out of the first normal expanded positions 160, 165.

Figure 6:
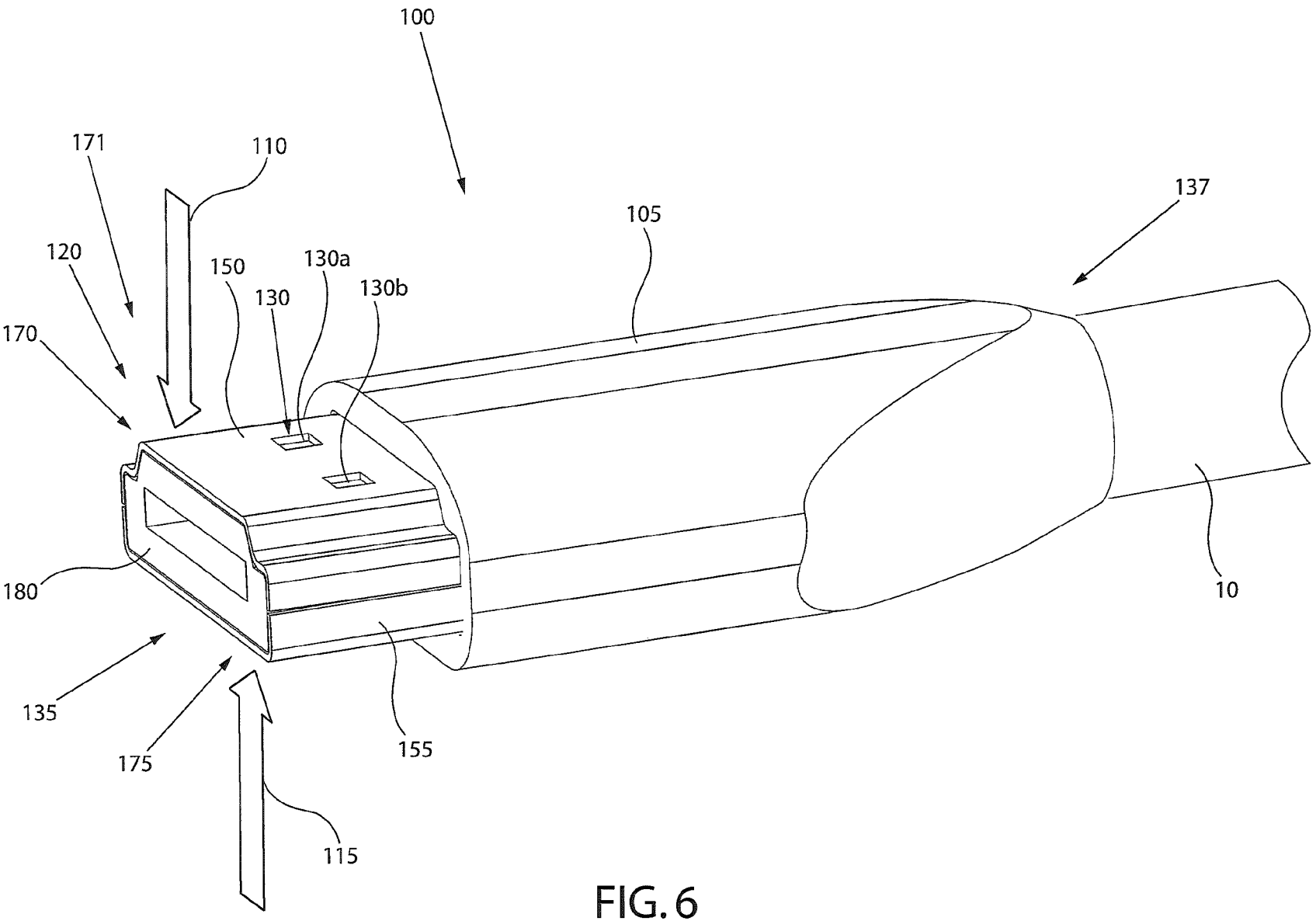
FIG. 6 depicts a perspective view of an embodiment of a self-retaining connector in a closed second unexpanded position, in accordance with the present invention.

With continued reference to the drawings, FIG. 6 depicts a perspective view of an embodiment of a self-retaining connector 100 in a closed position 171. In particular, as depicted, the first and second retaining portions 150, 155 are oriented in respective second unexpanded positions 170, 175, wherein the retaining portions 150, 155 do not extend a significant distance away from the inner plug section 180. When in a second unexpanded position 170, the first retaining portion 150 is in close proximity to the inner plug section 180 at the first end 135. Likewise, when in a second unexpanded position 175, the second retaining portion 155 is also in close proximity to the inner plug section 180 at the first end 135. Accordingly, the outer dimensions of the first plug end 135 of embodiments of a self-retaining connector 100 may be smaller than corresponding dimensions of a typical HDMI jack 20 (see FIGS. 1-4) when the self-retaining connector 100 is in a closed position 171. Thus, the connector 100 may be inserted unhindered into the typical HDMI jack 20. When inserted, the jack mating structures 130*a-b* of the first retaining portion 150 can appropriately align with common friction interference fittings, such as spring biased tabs 22 positioned in openings 25, of the typical HDMI jack 20.

Force must be applied to move the self-retaining connector 100 generally from an open position 161 to a closed position 171. Furthermore, not only must force be applied to move component features of the connector 100 to situate the connector 100 in a closed position 171, but force must be continuously applied in order to maintain the connector 100 in the closed position 171. For example, to move the first retaining portion 150 from a first normal expanded position 160 to a second unexpanded position 170, wherein the first retaining portion 150 resides substantially against the inner plug section 180, a first compression force 110, in a direction shown by the exemplary arrow, must be provided. Moreover, since the normal free state position of the connector 100 is the open position, wherein first retaining portion 150 is the expanded position 160 being opened up away from the inner plug section 180, the first force 110 must be continuously provided or the first retaining portion 150 will tend to return toward the first expanded position 160. The first retaining portion 150 is configured to resist movement away from the first normal expanded position 160. Similarly, to move the second retaining portion 155 from a first normal expanded position 165 to a second unexpanded position 175, a second compression force 115 must be applied. The first force 110 and/or the second force 115 may be provided by various means. For instance, the plug body 105 may be somewhat compliant in that a user may squeeze opposite sides of the body 105 to compress the body and other component elements within the body to act upon the first and/or second retaining portions 150, 155. Various other force application means are discussed in further detail herein below.

Figure 7:
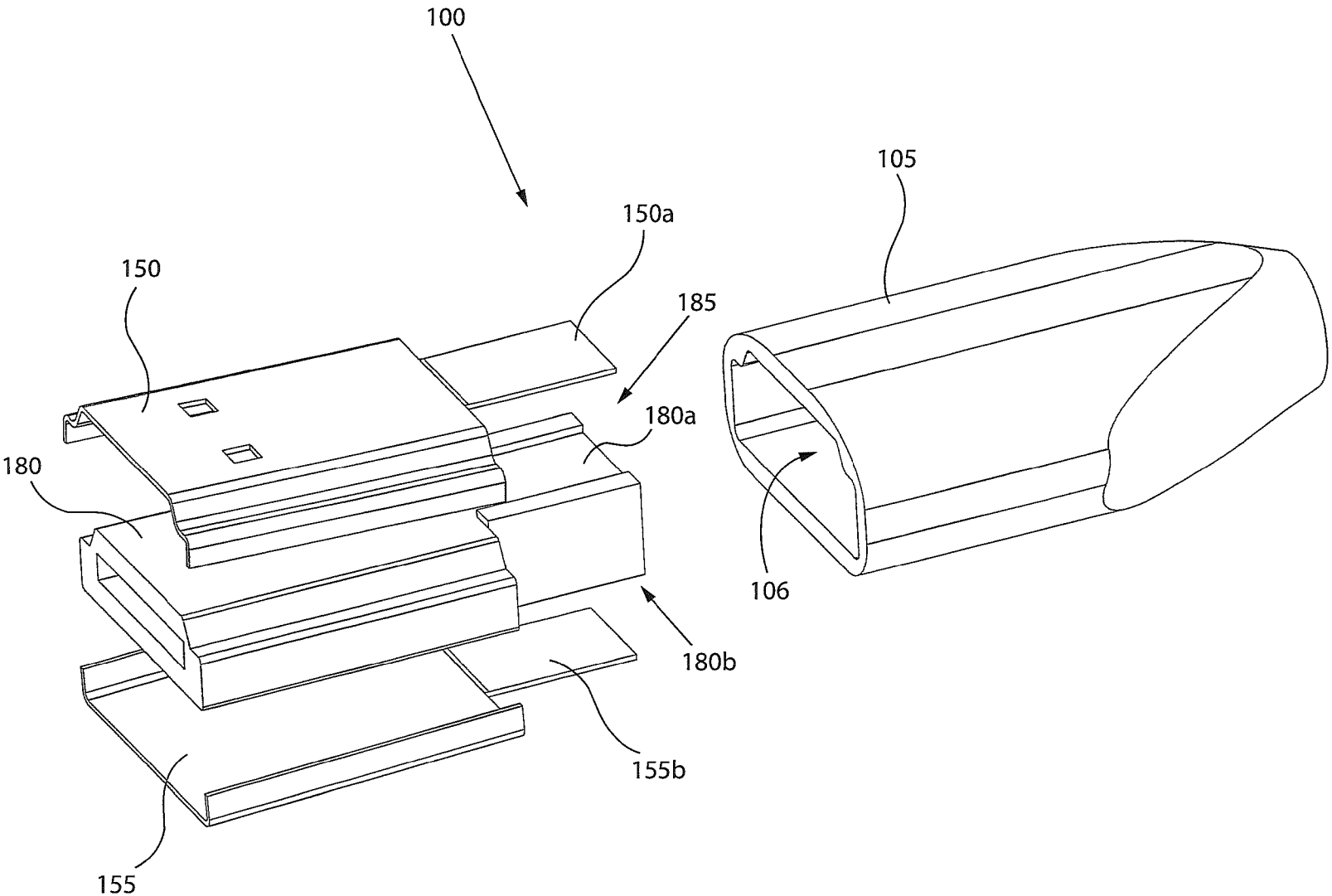
FIG. 7 depicts an exploded perspective view of an embodiment of a self-retaining connector, in accordance with the present invention.

FIG. 7 depicts an exploded perspective view of an embodiment of a self-retaining connector 100. The depiction shows the first and second retaining portions 150 and 155 and also the inner plug section 180 as being separate and distinct components. However, one skilled in the art should recognize that the retaining portions 150, 155 may be connected, integrated with, or otherwise joined to the inner plug section 180 to form one single component, as long as the retaining portions 150, 155 remain operable to move between a first biased position 160 and a second unbiased position 170 (see FIGS. 5-6). The plug body 105 may have a hollow cavity 106 into which various connector 100 components, such as the retaining portions 150, 155 and inner plug section 180 may be at least partially positioned. The plug body 105 may be formed of a semi-compliant or somewhat flexible material that allows for the body 105 to squeeze, stretch, or compress, particularly in relation to the hollow cavity 106. Hence, if an external force, such as force 110 or force 115, is applied to the plug body 105, the body 105 may tend to bend or compress inward toward the hollow cavity 106. However, the body 105 should be formed of durable material(s) that help protect interior components and prolong the life of the self-retaining connector 100.

The inner plug section 180 may include a cable connection plug section end 185. The cable connection plug section end 185 is configured to help facilitate connection of a multi-conductor cable 10 (see FIGS. 5-6). Additionally, the cable connection plug section end 185 may include retaining portion mating structures 180*a* and also 180*b* (hidden in the view). The retaining portion mating structures 180*a-b* may be sized to physically associate with inner support structures 150*a* and 155*b* of the first and second retaining portions 150, 155. The physical association between the retaining portion mating structures 180*a-b* of the inner plug section 180 and the inner support structures 150*a* and 155*b* of the retaining portions 150 and 155 may also facilitate electrical connection between the associated parts. Hence, the associated parts may be electrically integrated. The inner support structures 150*a* and 155*b* of the first and second retaining portions 150, 155 may also be configured to physically operate with the body 105. Accordingly, the body 105 may be formed to contact the inner support structures 150*a* and 155*b* to restrict, guide or facilitate movement of the support structures 150*a*, 155*b*.

Figure 8:
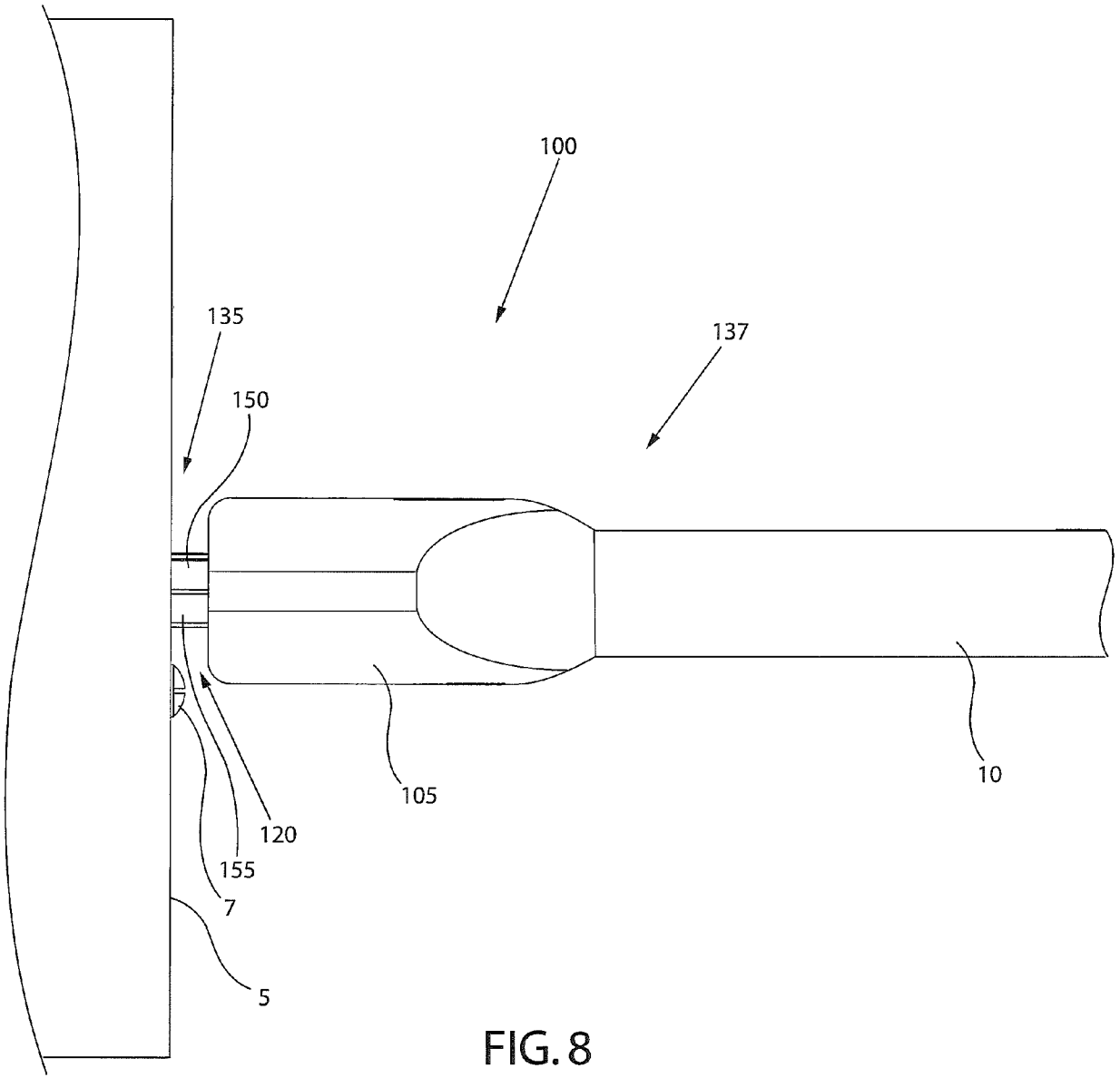
FIG. 8 depicts a side view of an embodiment of a self-retaining connector mated with a standard HDMI jack, in accordance with the present invention.
Figure 9:
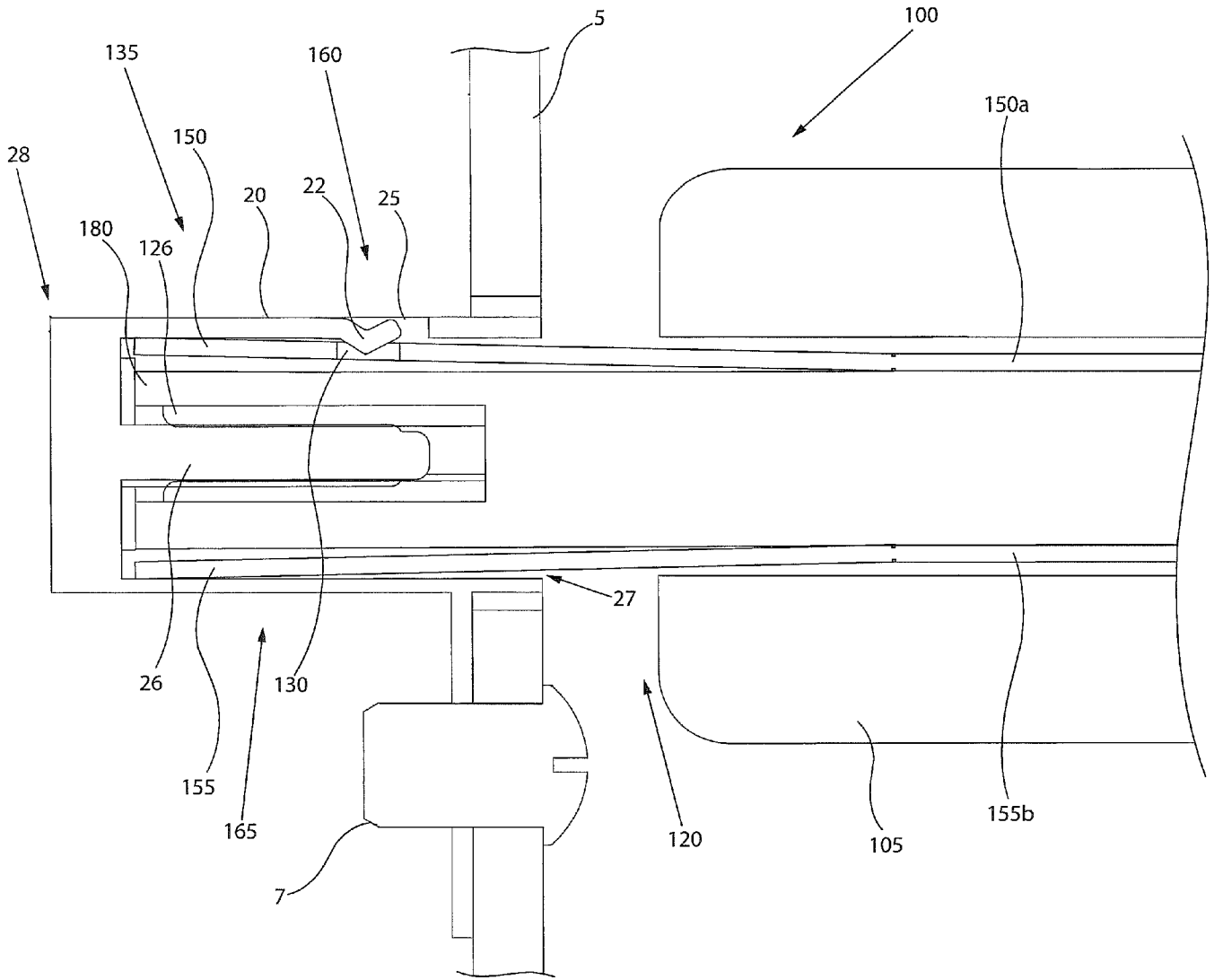
FIG. 9 depicts a partial cutaway side view of an embodiment of a self-retaining connector mated with a standard HDMI jack, in accordance with the present invention.

Referring further to the drawings, FIG. 8 depicts a side view of an embodiment of a self-retaining connector 100 mated to a standard HDMI jack 20 (shown further in FIG. 9). The standard HDMI jack 20 may be secured to a housing 5, for example, by a mounting screw 7. The housing 5 may be any physical component of a high definition electrical device. For example, the housing 5 may be the outer casing of a flat-screen HD television, the shell of a cable TV box, or the covering of a DVD player. The first plug end 135 of the self-retaining connector 100 may be plugged into, or otherwise inserted with in a portion of the jack receptacle 20 to facilitate a connection and allow transmission of electronic communications through the self-retaining connector 100. An extension 120 may extend from the plug body 105 and be configured to be inserted into the jack receptacle 20.

A partial cutaway side view of an embodiment of a self-retaining connector 100 mated with a standard HDMI jack 20 is depicted in FIG. 9. The self-retaining connector 100 includes multiple terminal contacts 126. The plug terminal contacts 126 are configured to mate with a receptacle port contact 26 of the jack 20. A typical HDMI jack 20, as described, may commonly have a sidewall opening 25 with a spring biased tab 22 (as shown in FIG. 1). The sidewall opening 25 is located on the surface of the jack receptacle and generally permits the spring biased tab 22 to protrude somewhat into a 1030 detent(s) of a standard HDMI connector 1000 (see FIGS. 1-4). Hence, when the spring biased tab(s) 22 protrude into the typical detent(s) of a standard HDMI connector, such as connector 1000, some mechanical interference between the parts is created to help retain the standard plug in mated position with the jack receptacle 20. However, the typical shape of the spring biased tabs 22 and the associated forces of the interference fit of the tabs 22 with openings or detents of a standard HDMI connector 1000 are often insufficient to effectively retain the standard HDMI connector 1000 in an appropriate mating position with the standard HDMI jack 20. Accordingly, embodiments of a self-retaining connector 100 are configured such that a typical spring biased tab 22 of a standard HDMI receptacle can protrude into a mating structure 130 of the retaining portion 150, once the connector 100 is inserted into the receptacle opening 27 of the standard HDMI jack 20 helping to secure the self-retaining connector 100 to the jack 20. When the first retaining portion 150 is in a first expanded position 160, the first retaining portion resiliently abuts the inner receptacle surface of the standard HDMI jack 20 and helps position the mating structure 130 into tightened alignment with the tab 22. The outward arrangement of the first retaining portion 150, when the portion 150 is in a first expanded position 160, serves to impede removal of the connector 100 from the standard HDMI jack 20 by exerting force against the inner receptacle surface of the jack 20 and more surely fitting the tab 22 into the mating structure 130 of the connector 100. Thus, the inclusion of a normally expanded first retaining portion 150 of the present invention facilitates a more effective mating condition when the self-retaining connector 100 is releasably mounted to a standard HDMI jack 20. Additionally, an included second retaining portion 155 may be located in a first expanded position 165 so as to also abut the inner receptacle surface of the standard HDMI jack 20. Hence, the second retaining portion may operate to provide a snug fit when the connector 100 is received by the jack receptacle 20 by exerting a force upon the inner receptacle surface. The reactive force produced by the outward bias of the second retaining portion 155 against the inner receptacle surface, when tending toward a second expanded position 165, serves to increase the tightness of the mated union of the connector 100 when received by the standard HDMI jack 20 and helps to more firmly position the typical tab 22 within the mating structure 130.

Figure 10:
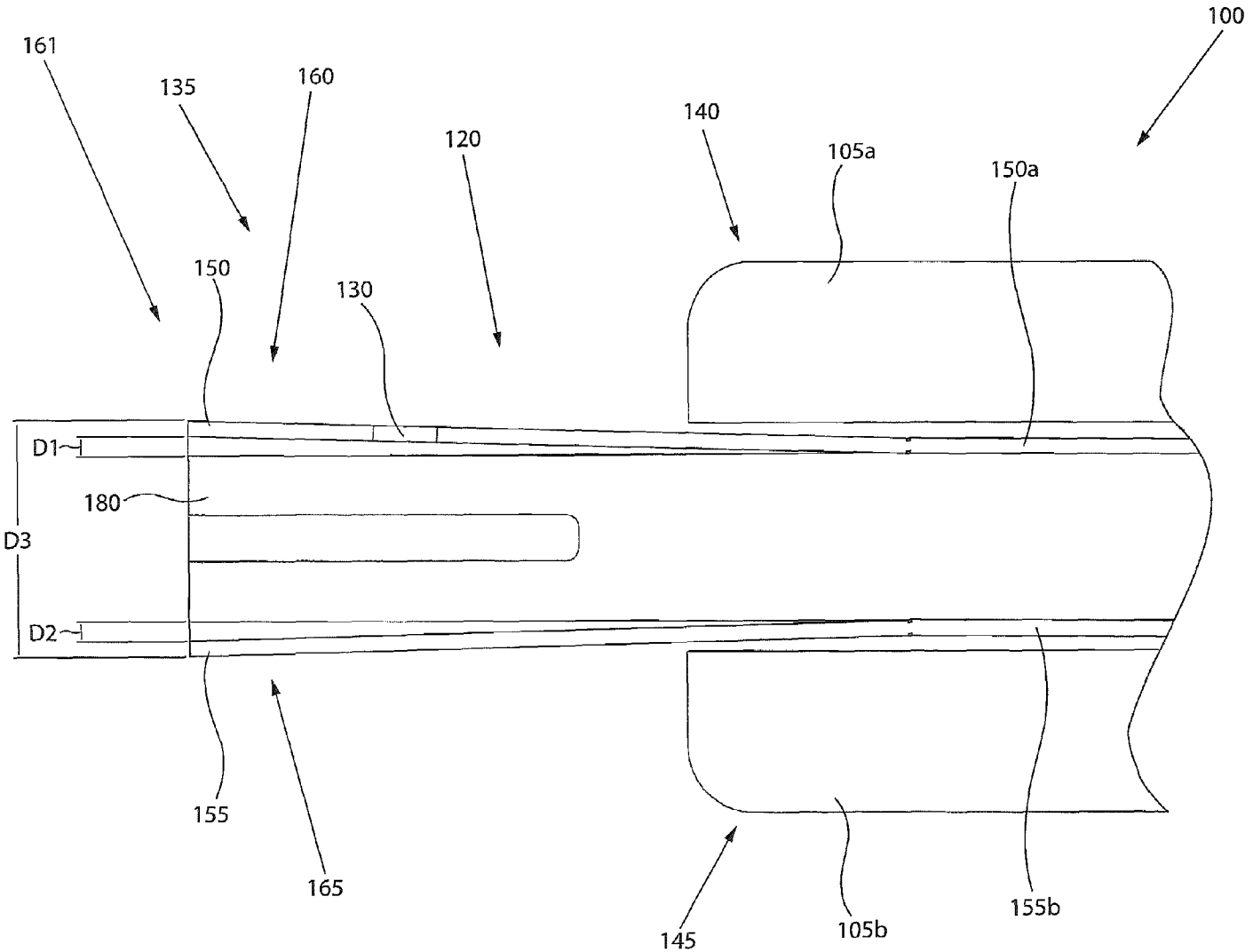
FIG. 10 depicts a partial cutaway side view of an embodiment of a self-retaining connector in an open first normal expanded position, in accordance with the present invention.
Figure 11:
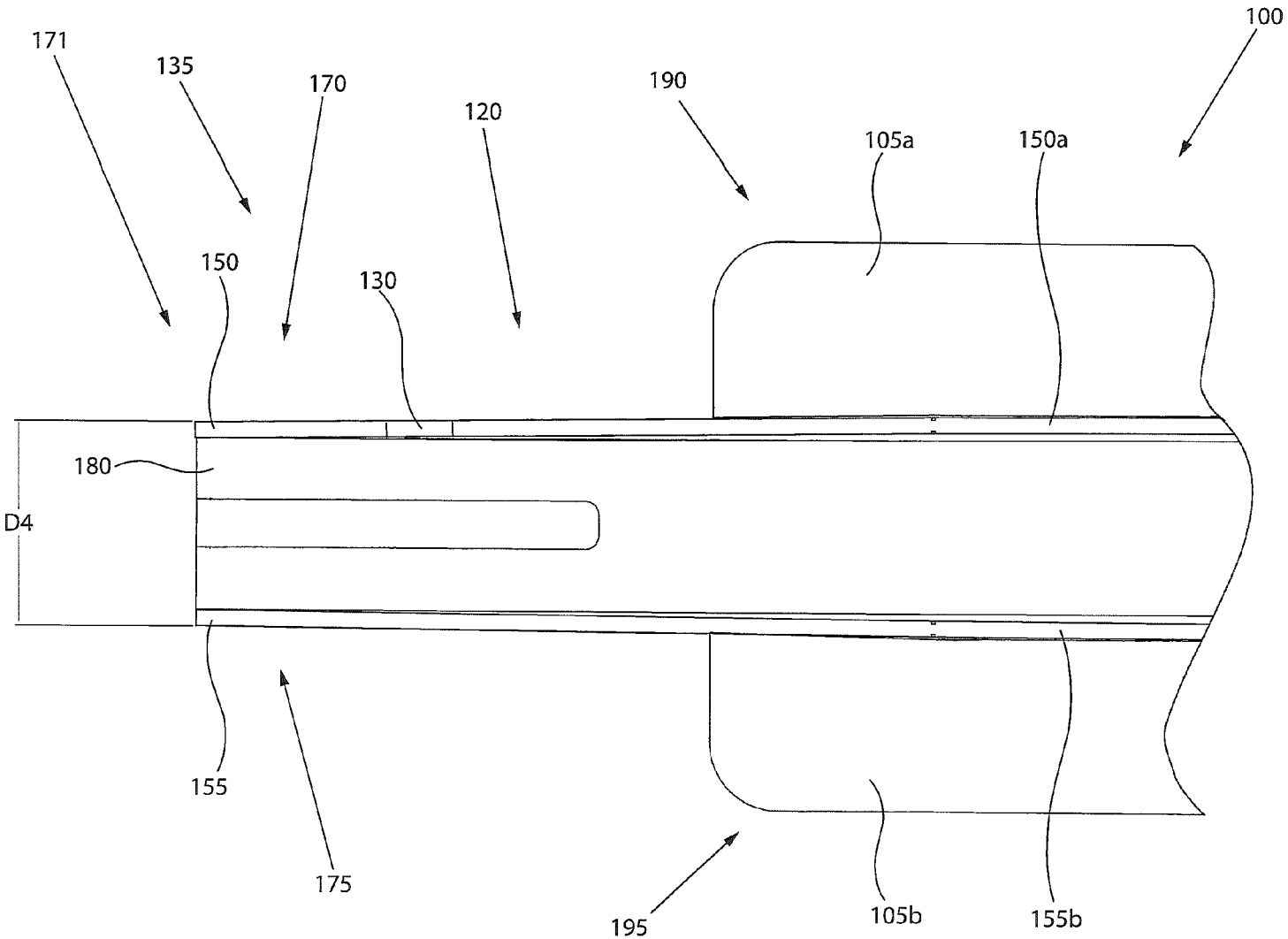
FIG. 11 depicts a partial cutaway side view of an embodiment of a self-retaining connector in a closed second unexpanded position, in accordance with the present invention.

With continued reference to FIGS. 8-9 and additional reference to FIGS. 10-11, embodiments of the self-retaining connector 100 are configured to permit easy insertion of the first plug end 135 into the receptacle opening 27 of the standard HDMI jack 20. For example, FIG. 10 depicts a partial cutaway side view of an embodiment of a self-retaining connector 100 in and open position 161, the connector 100 having a first retaining portion 150 in a first normal expanded position 160 and a second retaining portion 155 in a first normal expanded position 165. When the first retaining portion 150 is in a first expanded position 160, a corresponding first body portion 105*a* may be in a first body position 140 so that the body portion 105*a* does not compress the first retaining portion 150 or operate to locate the first retaining portion 150 out of its normal outwardly expanded first position 160. Moreover, the first body portion 105*a* does not operate to work upon inner support structure 150*a* of the first retaining portion 150 when the first body portion 105*a* is in a first body position 140. Similarly, when the second retaining portion 155 is in a first expanded position 165, a corresponding second body portion 105*b* may be in a first body position 145 so that the second body portion 105*b* does not compress the second retaining portion 155 or operate to locate the second retaining portion 155 out of its normal outwardly expanded first position 165. Furthermore, the second body portion 105*a* does not operate to work upon inner support structure 155*b* of the second retaining portion 155 when the second body portion 105*b* is in a first body position 145. At the extremity of the first plug end 135 of the connector 100, the first retaining portion 150 may be spaced away from the inner plug section 180 a distance D1 when the first retaining portion is in a first expanded position 160. The second retaining portion 155 may be spaced away from the inner plug section 180 a distance D2 when the second retaining portion 155 is in a first expanded position 165. The total outer dimension from the outer edge of the first retaining portion 150 to the outer edge of the second retaining portion 155 may be a distance D3 when the connector 100 is in an open position 161 and the retaining portions 155, 155 are in a first normal expanded position 160, 165. The distance D3 may be dimensionally larger than the typical receptacle opening 27 of a common HDMI jack 20. Hence, when the connector 100 is in an open position 161 the normal outwardly expanded configuration having of distances D1 and/or D2, and D3 related to the first expanded positions 160, 165 of the first and second retaining portions 150, 155 may need to be compressed or otherwise modified so the first plug end 135 of the self-retaining connector 100 may be inserted into the receptacle opening 27 of a standard HDMI jack 20.

Such a compressed configuration of an embodiment of the self-retaining connector 100 is depicted in FIG. 11 showing the connector in a closed position 171. The first body portion 105*a* may be maneuvered to a second body position 190, wherein the first body portion 105*a* compresses the first retaining portion 150 and operates to locate the first retaining portion 150 out of its normal outwardly expanded first position 160 to a second unexpanded position 170. There may be no significant distance between the first retaining portion 150 and the inner plug section 180 at the extremity of the first plug end 135 of the connector 100 when placed in a closed position 171. Moreover, the first body portion 105*a* may operate to work upon or otherwise physically interact with inner support structure 150*a* of the first retaining portion 150 when the first body portion 105*a* is in a second body position 190. Similarly, when the second retaining portion 155 is in a second unexpanded position 175, a corresponding second body portion 105*b* may be in a second body position 195 so that the second body portion 105*b* compresses the second retaining portion 155 and operates to locate the second retaining portion 155 out of its normal outwardly expanded first position 165 to a second unexpanded position 195. There may be no significant distance between the second retaining portion 155 and the inner plug section 180 at the extremity of the first plug end 135 of the self-retaining connector 100 when placed in a closed position 171. Furthermore, the second body portion 105*a* may operate to work upon inner support structure 155*b* of the second retaining portion 155 when the second body portion 105*b* is in a second body position 195. The total outer dimension from the outer edge of the first retaining portion 150 to the outer edge of the second retaining portion 155 may be a distance D4 when the retaining portions 155, 155 are in a second unexpanded position 170, 175 and the connector 100 is in a closed position 171. The distance D4 should be dimensionally smaller than the typical receptacle opening 27 of a standard HDMI jack 20 so that there is no significant physical impedance by the retaining portions 150, 155 during mating of the self-retaining connector 100 with the jack 20 when the first plug end 135 of the connector 100 is inserted into and/or retracted out of the receptacle opening 27 of the standard HDMI jack 20.

With continued reference to FIGS. 1-11, when mating a connector, such as a self-retaining audio/video high definition multi-contact connector 100, to a standard HDMI jack 20, a user may grip the plug body 105 and squeeze the body portions 105*a*, 105*b* to compress the first and second retaining portions 150, 155 from a first normal expanded position 160, 165 into an second unexpanded position 170, 175 so that the total dimension of the extremity of the first plug end 135, when the connector 100 is in a closed position 171, is a distance D4 dimensionally smaller than the typical receptacle opening 27 of a standard HDMI jack 20. Then the user may advance, push or otherwise insert the first plug end 135 of the connector 100 into the corresponding jack receptacle 20. Once the first plug end 135 is inserted into the jack 20, the user may release the body portions 105*a*, 105*b* allowing the retaining portions 150, 155 to return toward their first normal expanded positions 160, 165. When inserted, the retaining portions, such as portion 150, 155, may or may not move all the way back into a first normal expanded position 160, 165. Nevertheless, the inserted first plug end 135 is configured such that the typical spring biased tab 22 of the standard HDMI jack receptacle 20 can protrude into the mating structure(s) 130 of the shell portion 150, when the connector 100 is mated to the jack 20, thereby helping to secure the connector 100 to the jack 20. The first retaining portion 150 resiliently abuts the inner receptacle surface of the jack 20 and helps position the mating structure(s) 130 into tightened alignment with the tab(s) 22. The outward bias of the first retaining portion 150, when it tends to return towards the normal first expanded position 160, serves to impede removal of the connector 100 from the jack 20 by exerting force against the inner receptacle surface of the HDMI jack 20 and more surely fitting the typical tab(s) 22 into the mating structure(s) 130 of the connector 100.

Figure 12:
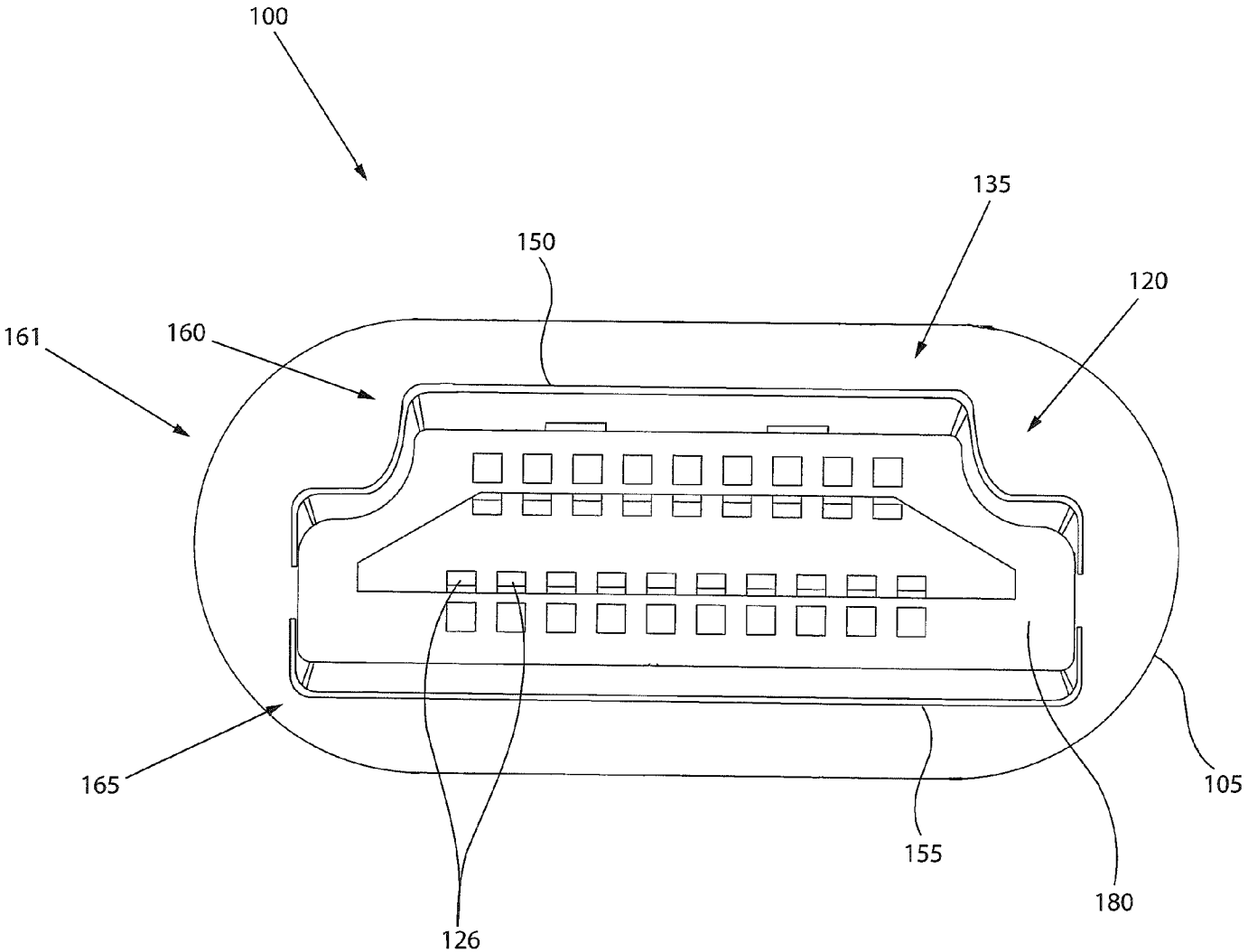
FIG. 12 depicts an end view of an embodiment of a self-retaining connector in an open first normal expanded position, in accordance with the present invention.
Figure 12B:
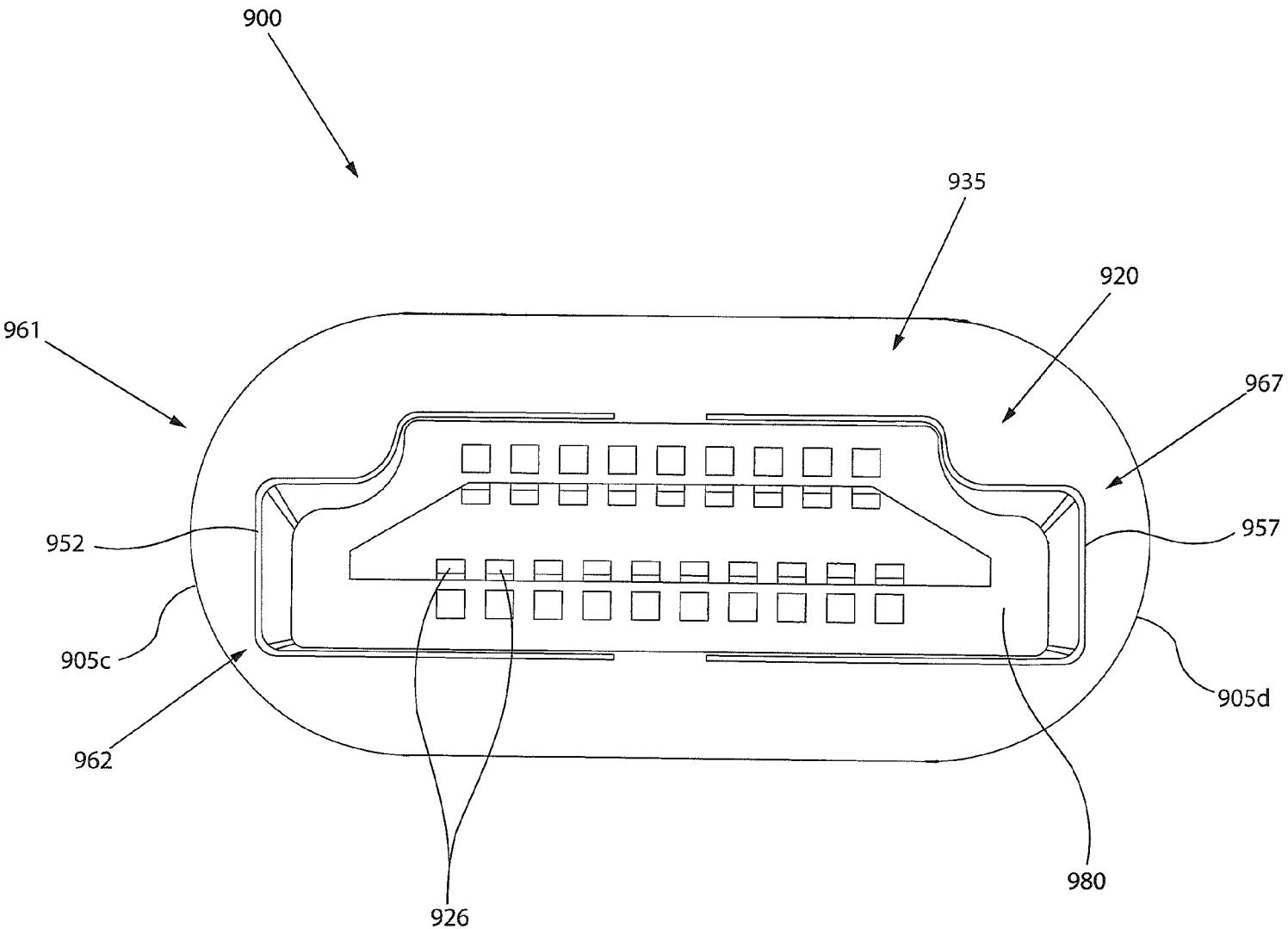
FIG. 12*b* depicts an end view of another embodiment of a self-retaining connector in an open first normal expanded position, in accordance with the present invention.
Figure 13:
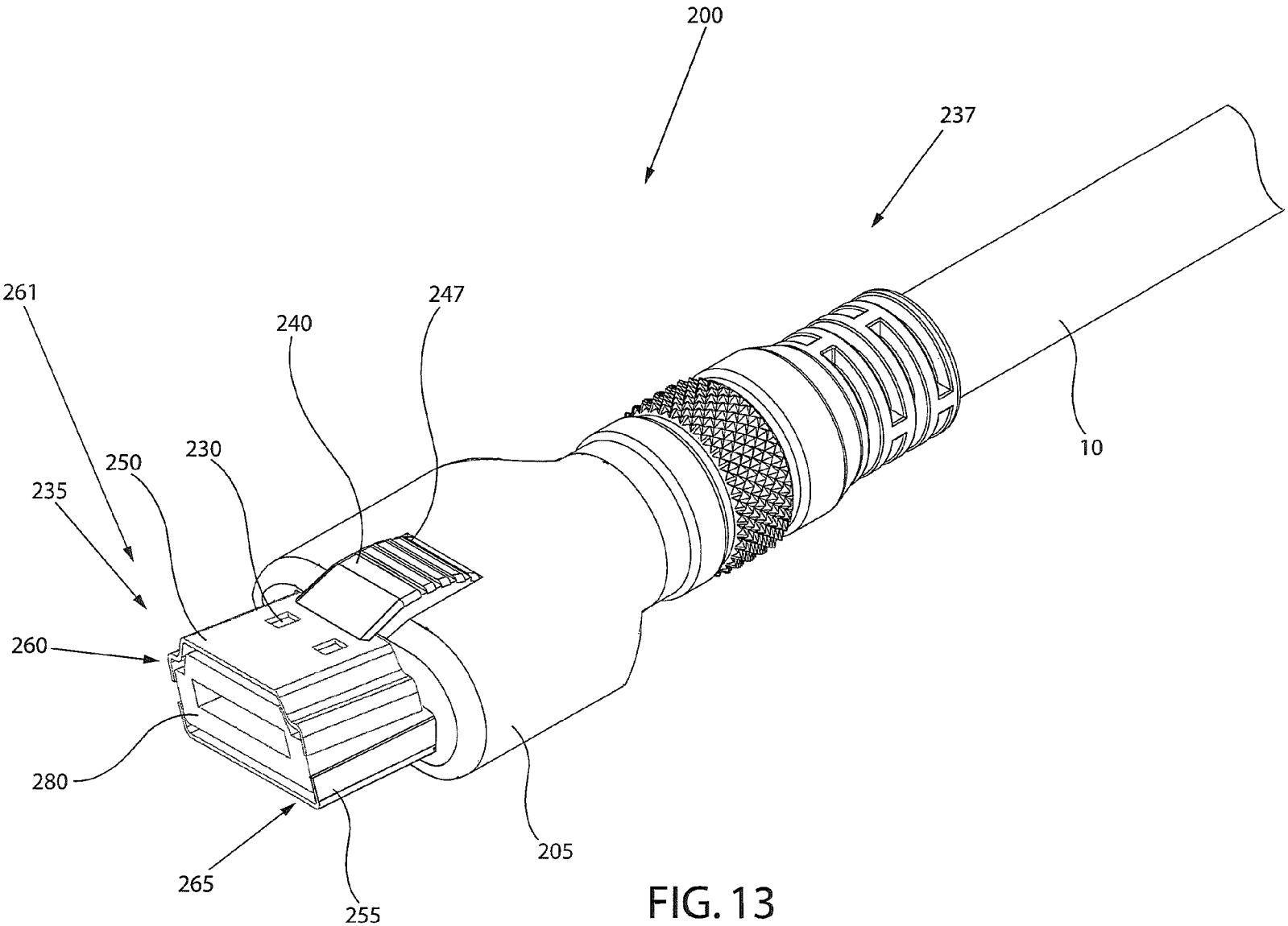
FIG. 13 depicts a perspective view of an embodiment of a self-retaining connector having an actuator button, in accordance with the present invention.

Embodiments of a self-retaining connector 100 may comprise an inner plug section 180, the first plug end 135 of which is shown in FIG. 12. The inner plug section 180 may include multiple plug terminal contacts 126 configured to physically and electrically contact corresponding receptacle port contacts 26 (see FIG. 9) of a typical HDMI jack receptacle 20. A connector, such as a self-retaining audio/video high definition multi-contact connector 100, may be HDMI compatible. HDMI compatible plug terminal contacts 126 are further delineated in FIGS. 15-16. Accordingly, a self-retaining connector embodiment 100 may include 19 terminals, as in either a typical Type A or a typical Type C HDMI standard connector (see FIG. 15) or 29 terminals that are typically present in a standard Type B HDMI connector (see FIG. 16). The inner section 180 may be integrally formed with the extension 120, may be separately joined to the extension 120, or may be removably secured within the extension 120 of the connector 100. Moreover, the plug terminal contacts 126 may be integrally formed as part of the inner plug section 180, may be separately joined to the inner plug section 180, or may be removably secured to the inner plug section 180. The inner plug section 180 may be formed of conductive materials or may be formed of a dielectric material. When the terminal contacts 126 are in electrical contact with the port contacts 26, electromagnetic transmissions may be communicated through the associated electrical connection. The standard HDMI jack 20 may facilitate electrical communication with other electrical components. For example a circuit connection end 28 (see FIG. 9) of the standard jack receptacle 20 may include contacts or leads that make possible the further communication of electromagnetic signals to various electronic devices. In FIG. 12, the connector 100 is depicted in an open position 161, wherein the first retaining portion 150 is in a first normal expanded position 160 and the second retaining portion 155 is in a first normal expanded position 165.

Those in the art should appreciate that an HDMI compatible connector need not include a first retaining portion substantially structurally and/or functionally similar to a first retaining portion 150 of a self-retaining connector embodiment 100. A self-retaining connector may include a free state open position wherein a first retaining portion is located in an expanded position differently and is operable in a manner unlike that of first retaining portion 150. For example, FIG. 12*a* depicts another embodiment of a self-retaining connector 900 in an open position 961. The self-retaining connector 900 includes a first plug end 935 having an inner plug section 980 that is partially surrounded by a first retaining portion 952. The connector 900 may also include a second retaining portion 957. As opposed to the vertically stacked positioning and horizontally split operation of the first and second retaining portions 150, 155 of a self-retaining connector 100, the first and second retaining portions 952, 957 of a connector 900 may be horizontally positioned with respect to each other and may operate opposite a vertical split. Hence compression forces and complimentary retaining portion positioning restoration forces that may effectively work upon or by the connector 900 may be applied or resultant in directions that are orthogonal to the directions of forces 110 and 115 (see FIG. 6) that effectuate self-retaining connector 100. For instance, a user may squeeze and apply force to horizontal body portions 905*c* and 905*d* to compress the corresponding first and second retaining portions 952 and 957 to move the retaining portions 952 and 957 from their first normal expanded positions 962 and 967 to unexpanded positions (not shown, but corresponding to a closed position of the connector 900). In the unexpanded positions, the retaining portions 952, 957 are in close proximity to the inner plug section 980 at the first plug end 935. The first and second retaining portions may include mating structures (not shown) that could engage the typical spring biased tabs of a standard HDMI jack 20. Like a connector 100, a connector 900 may also have an extension 920 extending from the plug body 905 and may include multiple terminal contacts 926. Those in the art should further appreciate that a self-retaining connector may have more that two retaining portions. For instance, a self-retaining connector may have four retaining portions split vertically and horizontally and possibly operable with four portions of the plug body.

The self-retaining connector 100 may be moved into and/or may be moved out of the receptacle opening 27 of a typical jack 20 by operation of a button, tab, lever, or other physical actuator. For example, self-retaining connector embodiment 200 may include a button 240. The button 240 may be operable with a body 205 and may be configured to be depressed, or made to slide forward and backward, to slide side-to-side, or otherwise set in motion to act upon and move a first retaining portion 250 and/or second retaining portion 255. The first retaining portion 250 may have at least one mating structure 230 (as shown, a first retaining portion preferably includes two mating structures 230, such as openings 130*a*, 130*b* of connector embodiment 100). A first plug end 235 may be configured to fit into a standard HDMI jack receptacle 20, or may be configured to be used with any other HDMI compatible receptacle that relies upon a friction or tolerance fit to retain the first plug end 235 within the receptacle opening 27 of a standard HDMI jack 20. The HDMI standard provides for a conductive surface for the first retaining portion 250, but in other applications the first retaining portion 250 may be an insulator. As pertaining to various self-retaining connector embodiments, the first retaining portion 250 may be a metal that is stamped or otherwise formed into the desired shape or may be a conductive polymer that is injection molded or extruded. The first retaining portion 250 may be formed of dimensionally stable materials that could be made conductive if required to be used in HDMI compatible connectors. The self-retaining connector 200 has an open position 261. Similar to the first retaining portion 150 of connector embodiment 100, the first retaining portion 250 of connector embodiment 200 should have a first normal expanded position 260, wherein the first retaining portion extends away from an inner plug section 280. The inner section 280 may be any structurally rigid material such as an injection molded plastic piece, extruded and cut component, or other physical member that would allow the introduction of the terminals, such as terminals 126 (see FIG. 12). The self-retaining connector 200 may have a second retaining portion 255 normally positioned in a first expanded position 265 similar to the first retaining portion 155 of connector embodiment 100.

A user may operate the button 240 either by compression or sliding until it is moved sufficiently to work upon the first retaining portion 250 to move the first retaining portion from a normal resiliently expanded first position 260 into a second unexpanded position 270 (not shown, but similar to the second unexpanded position 170 of the first retaining portion 150 of connector embodiment 100). In the second unexpanded position, the first retaining portion 250 is in close proximity to the inner plug section 280 at the first plug end 235. The button 240 may be compressed during insertion of the first plug end 235 into a standard HDMI jack 20 and then released to return the first retaining portion 250 toward a first normal expanded position 260 once resiliently engaged into a receptacle 20. The movable first and second retaining portions 250, 255 may be produced from a resilient material such as spring-type steel or a resilient polymeric material that is either stamped or injection molded. The button 240 may include a diving hinge operable with the plug body 205. Such a hinged button 240 may be attached to the plug body 205 or integrally formed with the plug body 205 such that the button 240 attaches to the plug body 205 in the general vicinity of a location near the first plug end 235 of the connector 200. A user may operate the button 240 by pressing the button 240 toward the first retaining portion 250, or by otherwise moving the button 240 to generate a compression force, such as force 110 (see FIG. 6). The button 240 is configured such that motive force provided by a user transfers from the button 240 to the first retaining portion 250 to move the first retaining portion 250. Accordingly, a user can insert the first plug end 235 into a jack receptacle 20 and assist the action of firmly connecting the connector 200 through the hinged operation of the button 240. Surface features 247, such as ridges, may be provided on the exterior surface of the button 240 to correspond to a better user interface during operation. The button 240 may also contact or otherwise interact with the second retaining portion 255 to actuate the second retaining portion 255 and move it from a first expanded position 265 to a second unexpanded position 275 (not shown, but similar to second unexpanded position 175 of second retaining portion 155 of self-retaining connector embodiment 100). In the second unexpanded position, the second retaining portion 255 is in close proximity to the inner plug section 280 at the first plug end 235. A multi-conduit cable 10 is connected to the self-retaining connector 200 at a second cable connection end 237 opposite the first plug end 235.

Figure 14:
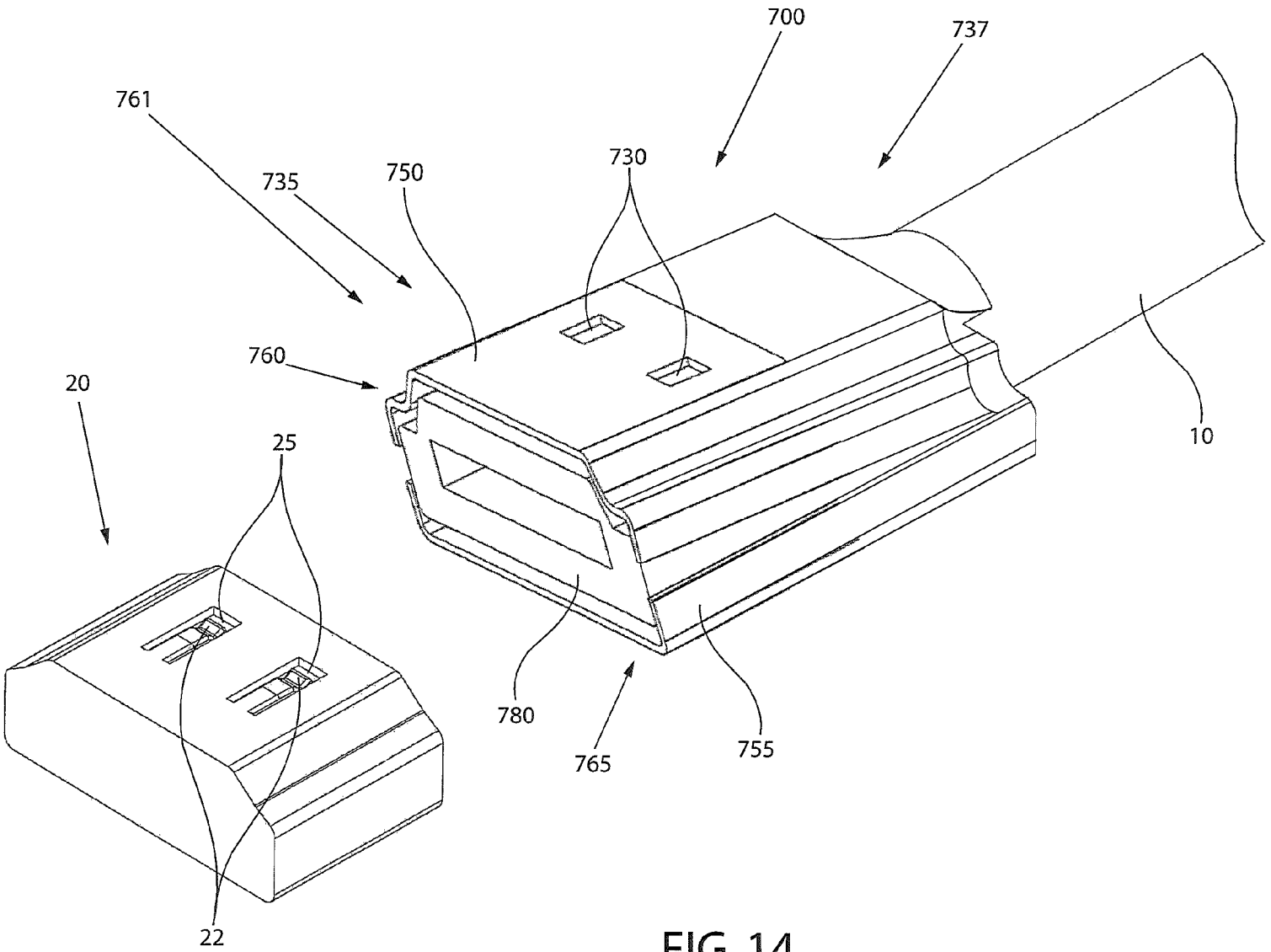
FIG. 14 depicts a perspective view of another embodiment of a self-retaining connector prior to mating with a standard HDMI jack.

FIG. 14 depicts a perspective view of another self-retaining connector embodiment 700 prior to mating with a standard HDMI jack receptacle 20. The connector 700 includes a receptacle-shaped first plug end 735 configured to mate with and be inserted into the standard jack 20. An inner plug section 780 is partially surrounded by a first retaining portion 750. The inner plug section may also be at least partially surrounded by a second retaining portion 755. When the connector 700 is in an open position 761, the first retaining portion 750 normally resides in a first normal expanded position 760. Likewise, the second retaining portion 755 normally resides in a first expanded position 765. A multi-conduit cable 10 may be connected to the inner plug section 780 at the second cable connection end 737 opposite the first plug end 735. The first retaining portion 750 may include one or more mating structures 730 located on the retaining portion 750 so that the mating structures 730 engage typical tabs 22 of the standard HDMI jack 20. A user may compress the open first and second retaining portions 750, 755 moving them from their first normal expanded positions 760, 765 and closing them to second unexpanded positions 770, 775 (not shown, but similar to the second unexpanded positions 170, 175 of first and second retaining portions 150, 155 of connector embodiment 100). When compressed to their second unexpanded positions, the first and second retaining portions 750, 755 are in close proximity to the inner plug section 780 at the first plug end 735. When compressed the connector 700 is in a closed position, the first plug end 735 may be inserted into the standard HDMI jack 20. The plug 700 may be released, unmounted, unplugged, or otherwise removed from the jack 20 by compressing the first and second retaining portions 750 out of mated engagement with the tabs 22 of the jack receptacle 20 and then pulling and/or sliding the first plug end 735 out of the standard jack 20.

Embodiments of a self-retaining connector, such as connectors 100, 200, and 300 may be configured as shown in FIGS. 15 and 16 to be compatibly inserted into a high definition multimedia interface receptacle corresponding to Type A, B, or C High Definition Multimedia Interface plug standards. Moreover, embodiments of a self-retaining connector 100/200/700/900 may have movable retention means located on the first plug end 135/235/735 for firmly but releasably retaining the connector 100/200/700/900 in a mated position with the standard HDMI jack 20, as discussed above. The movable retention means may include a first retaining portion 150/250/750/952 normally expanded outward from an inner plug section 180/280/380/980 at the first plug end 135/235/735/935 of the connector 100/200/700/900. The expanded configuration of the first plug end 135/235/735.935 should be configured so that the retaining portion 150/250/750/952 physically interacts with the standard HDMI jack 20 creating friction forces to help retain the connector 100/200/700/900 in a mated condition with the jack 20. Moreover, the retention means may include a second retaining portion 155/255/755/957 physically located and operable in a manner similar to the first retaining portion 150/250/750/952. Both the first and second retaining portions 150/250/750/952, 155/255/755/957 may work in conjunction with each other to exert force on the standard jack receptacle 20 and self-retain the connector 100/200/700/900 in a mated position with the jack 20. Furthermore, the retention means may include any physical feature configured to movably engage and interfere with a typical tab 22 of a standard HDMI jack 20 to help retain the connector 100/200/700/900 in the jack receptacle 20 by impeding removal of the first plug end 135/235/735/935 from the jack 20. For instance, the first retaining portion 150/250/750 may include a mating structure 130/230/730, such as a hole or other feature such as a detent, slot, trough, lip, or ridge that may engage a tab 22 of standard HDMI jack 20.

A method of connecting a connector 100/200/700/900 to a corresponding standard HDMI jack 20 is depicted in reference to FIGS. 5-15 and comprises providing an audio/video high definition multi-contact connector 100/200/700/900, the connector 100/200/700/900 including a first plug end 135/235/735/935 configured to be inserted into a receptacle opening 27 of a standard HDMI jack 20. The connector 100/200/700/900 also includes a compressible first retaining portion 150/250/750/952 that physically extends away from an inner plug section 180/280/780/980 at the first plug end 135/235/735/935 when the compressible first retaining portion 150/250/750/952 resides in a first normal expanded position 160/260/760/962. The first retaining portion 150/250/750/952 may have at least one mating structure 130/230/730, such as a hole or other physical feature configured to interact with a typical tab 22 of a standard HDMI jack 20. The connector 100/200/700/900 may further be connected to a standard HDMI jack 20, by applying a force, such as force 110 or any other operable force, to compress the first retaining portion 150/250/750/952 and move the first retaining portion 150/250/750/952 to a second unexpanded position 170/(270/770—not shown but similar to 170; 972 not shown), so that the dimension of the first plug end 135/235/735/935 is smaller than the receptacle opening 27 of a standard HDMI jack 20. In the second unexpanded position, the first retaining portion 150/250/750/952 is in close proximity to the inner plug section 180/280780/980 at the first plug end 135/235735/935. Then the first plug end 135/235/735/935 of the connector 100/200/700/900 may be inserted into the standard HDMI jack 20. Once inserted, the compression force, such as force 110 or any other operable force, can be released and the first retaining portion 150/250/750/952 can resiliently return towards its first normal expanded position 160/260/760/962 so that the retaining portion 150/250/750/952 exerts a resultant force upon the standard HDMI jack 20. Then the first plug end 135/235/735935 of the connector 100/200/700/900 may be operably positioned in the standard HDMI jack 20 to tighten the connection of the connector 100/200/700/900 with the jack 20 and impede removal of the connector 100/200/700/900. Furthermore, the at least one mating structure 130/230/730 may engage the tab 22 of the standard HDMI jack 20 to further hinder the ability of the connector 100/200/700/900 to be removed from the jack 20 unless the first retaining portion 150/250/750/952 is moved to disengage the tab 22.

Additional methodology for connecting a connector 100/200/700/900 may include the provision of a second retaining portion 155/255/755/957 that physically extends away from an inner plug section 180/280/780/980 at the first plug end 135/235/735/935 to normally reside in a first expanded position 165/265/765/967 similar to the first expanded position 160/260/760/962 of the first retaining portion 150/250/750/952. A force, such as force 115 or any other operable force, may be applied to compress the second retaining portion 155/255/755/957 and move the second retaining portion 155/255/755/957 to a second unexpanded position 175/(275/775—not shown but similar to 175; 977 not shown), so that the dimension of the first plug end 135/235/735/935 is smaller than the receptacle opening 27 of a standard HDMI jack 20. In the second unexpanded position, the second retaining portion 155/255/755/957 is in close proximity to the inner plug section 180/280780/980 at the first plug end 135/235735/935. Then the first plug end 135/235/735/935 of the connector 100/200/700/900 may be inserted into the jack receptacle 20. Following insertion, the compression force, such as force 115 or any other operable force, can be released and the second retaining portion 155/255/755/957 can resiliently return towards its first normal expanded position 165/265/765/967 so that the retaining portion 155/255/755/957 exerts a force upon the jack 20 to tighten the connection of the connector 100/200/700/900 with the jack 20 and impede removal of the connector 100/200/700/900.

Removal of embodiments of a self-retaining connector 100/200/700/900 may comprise re-exerting or re-applying a force, such as 110, 115, or any other operable force, to move the first and second retaining portions 150/25/750/952, 155/255/755/957 to an unexpanded position so that the dimension of the first plug end 135/235/735/935 is smaller than the receptacle opening 27 of the standard HDMI jack 20 and so that the retaining portions 150/250/750/952, 155/255/755/957 do not exert force upon the jack 20. Then the first plug end 135/235/735/935 may be unhindered for removal from the jack 20 by pulling and/or sliding the connector 100/200/700/900 out of the jack 20. Once free from the jack 20, the applied compression force, such as force 110, 115 or any other operable force, may be released and the first and second retaining portions 150/250/750/952, 155/255/755/957 may return toward normal first expanded positions 160/260/760/962, 165/265/765/967.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims. The claims provide the scope of the coverage of the invention and should not be limited to the specific examples provided herein.

What is claimed is:

1. A self-retaining audio/video high definition multi-contact connector comprising:

a first end, configured to be inserted into a standard HDMI jack; and an inner plug section, forming a portion of the first end, the inner plug section being partially surrounded by a first retaining portion movable from a first normal expanded position, wherein the first retaining portion extends a distance away from the inner plug section at the first end, to a second unexpanded position wherein the first retaining portion is in close proximity to the inner plug section at the first end, and wherein the first retaining portion is configured to exert a restoring force back toward the first position when the first retaining portion is within the standard HDMI jack;

wherein the inner plug section includes a plurality of plug terminal contacts configured to physically and electrically contact corresponding receptacle port contacts of the standard HDMI jack; and wherein the first retaining portion facilitates an electrical connection between corresponding mating surfaces of the standard HDMI jack.

2. The self retaining connector of claim 1 further comprising a second retaining portion, the second retaining portion extending a distance away from the inner plug section at the first end when in a first normal expanded position.

3. The self retaining connector of claim 1, wherein the first retaining portion includes a mating structure sized and positioned in relation to the first plug end of the connector so that the mating structure is aligned to physically mate with a spring biased tab of a typical HDMI jack.

4. The self-retaining connector of claim 1, wherein the first retaining portion includes two mating structures both sized and positioned with relation to the first plug end of the connector so that the mating structures are aligned to physically mate with spring biased tabs of a typical HDMI jack.

5. The self retaining connector of claim 1 further comprising a plug body.

6. The self retaining connector of claim 5 further comprising a button operable with the plug body to move the first retaining portion from a first expanded position to a second unexpanded position.

7. The self retaining connector of claim 5 further comprising an extension extending from the plug body.

8. The self-retaining connector of claim 1 further comprising a plurality of terminal contacts.

9. The self retaining connector of claim 1 further comprising a cable connection end.

10. A high definition multimedia interface compatible connector comprising:

a plug end, the plug end including an inner plug section, an outer movable first retaining portion, the movable first retaining portion being movable between a first open position spaced away from the inner plug section to a second closed position, and a second movable retaining portion, the second retaining portion spaced away from the inner plug section when in an open position;

wherein the plug end has a dimension larger than a receptacle opening of a standard HDMI jack, when the first retaining portion is in the first open position;

wherein the plug end has a dimension smaller than the receptacle opening of the standard HDMI jack, when the first retaining portion is in the second closed position; and wherein the first retaining portion facilitates an electrical connection between corresponding mating surfaces of the receptacle opening of the standard HDMI jack.

11. The high definition multimedia interface compatible connector of claim 10, wherein the first retaining portion includes two mating structures both sized and positioned in relation to the plug end of the connector so that the mating structures are aligned to physically mate with spring biased tabs of a typical HDMI jack.

12. The high definition multimedia interface compatible connector of claim 10 further comprising a plug body and an extension extending from the plug body.

13. The high definition multimedia interface compatible connector of claim 12 further comprising a button operable with the plug body to move the first retaining portion from an open position to a closed position.

14. A self retaining HDMI compatible connector comprising:

a plug end configured to be inserted into a standard HDMI jack; and movable retention means located on the plug end and partially surrounding an inner portion of the plug end having a plurality of plug terminal contacts for firmly but releasably retaining the connector in a mated position with the standard HDMI jack;

wherein the movable retention means facilitate an electrical connection between corresponding mating surfaces of the standard HDMI jack.

15. The self retaining HDMI compatible connector of claim 14, further comprising means for movably engaging spring biased tabs of the standard HDMI jack.

16. A method of connecting a connector to a standard HDMI jack, the method comprising:

providing an audio/video high definition multi-contact connector including:

an inner plug section having a first end configured to be inserted into a receptacle opening of a standard HDMI jack, the first end having a plurality of plug terminal contacts configured to physically and electrically contact corresponding receptacle port contacts of the standard HDMI jack; and a compressible first retaining portion that extends away from the inner plug section at the first end in a first normal expanded position;

applying a force to compress the first retaining portion and move the first retaining portion to a second unexpanded position having a dimension smaller than the receptacle opening of the standard HDMI jack;

inserting the first end of the connector into the standard HDMI jack; and releasing the compression force on the first retaining portion so that the first retaining portion resiliently returns toward its first normal expanded position and exerts a force upon the standard HDMI jack to impede removal of the connector from the jack, and so that the first retaining portion facilitates an electrical connection between corresponding mating surfaces of the standard HDMI jack.

17. The method of claim 16, wherein the connector further includes a second compressible retaining portion that physically extends away from an inner plug section at the first end when the compressible second retaining portion resides in a normal first expanded position.

18. The method of claim 16, wherein the first retaining portion includes two mating structures.

19. The method of claim 18, further comprising movably engaging the spring biased tabs of the standard HDMI jack when the first retaining portion resiliently returns back toward its first normal expanded position.

20. The method of claim 16, wherein the connector further includes:

a plug body;

an extension extending from the plug body; and a button operable with the plug body.

21. The method of claim 20, wherein the compression force is applied to the first retaining portion via operation of the button.

22. The method of claim 17, further comprising re-applying a compression force after the first end has been inserted into the standard HDMI jack to move the first retaining portion to an unexpanded position having a dimension smaller than the receptacle opening of the HDMI jack.

23. The method of claim 22 further comprising removing the first end from the jack and releasing the re-applied compression force so that the first and second retaining portions substantially return to their normal first expanded positions.

* * * * *